US006851881B2

(12) United States Patent
Slaboden

(10) Patent No.: US 6,851,881 B2
(45) Date of Patent: Feb. 8, 2005

(54) BRUSH ASSEMBLY WITH CONSUMABLE CLEANING AGENT

(76) Inventor: Jeffrey K. Slaboden, 639 Townsend Dr., Aptos, CA (US) 95003

( * ) Notice: Subject to any disclaimer, the term of this patent is extended or adjusted under 35 U.S.C. 154(b) by 0 days.

(21) Appl. No.: 10/349,332

(22) Filed: Jan. 21, 2003

(65) Prior Publication Data

US 2004/0141794 A1 Jul. 22, 2004

(51) Int. Cl.[7] ..... A45D 40/20; B43K 23/00

(52) U.S. Cl. ..... 401/88; 401/201; 401/207; 401/267; 401/268

(58) Field of Search ..... 401/88, 201, 40–43, 401/52, 119, 207, 267, 268, 290

(56) References Cited

U.S. PATENT DOCUMENTS 1,266,878 A * 5/1918 Strobhart ..... 401/201
1,933,291 A * 10/1933 Wolff ..... 401/201
2,673,998 A * 4/1954 Swartz ..... 401/201
3,199,139 A * 8/1965 Vallis ..... 401/201
3,368,233 A * 2/1968 Lemberger ..... 401/201

FOREIGN PATENT DOCUMENTS

DE 29718117 U1 * 1/1998 ..... A46B/5/02
EP 0005685 A1 * 11/1979 ..... A46B/11/04

* cited by examiner

*Primary Examiner*—Tuan Nguyen
(74) *Attorney, Agent, or Firm*—LaRiviere, Grubman & Payne, LLP

(57) ABSTRACT

A scrub brush with a handle by which the user grips the brush, a two-part scrubber portion which provides the scrubbing action, and a connecting staff between the handle and the scrubber. The scrubber may be of bristles, springy plastic mesh, rag-like or sponge material. The scrubber is designed so that a portion of the scrubber furthest from the handle can be compressed into a small diameter cylindrical shape of such dimension that a suitably sized ring of solid cleaning agent can pass over the compressed scrubber portion. When the compressed scrubber portion is released from its restraint, it expands to the original shape and size, thereby confining the ring of solid cleaning agent between the two scrubber portions.

20 Claims, 2 Drawing Sheets

BRUSH ASSEMBLY WITH CONSUMABLE CLEANING AGENT

TECHNICAL FIELD

The present invention relates generally to cleaning brushes and agents and more specifically to brushes with an associated consumable cleaning agent designed for cleaning sinks, bathroom fixtures such as a toilet bowl, food processing equipment, medical or commercial facilities, and the like.

BACKGROUND ART

Brushes are well known for use as an aid in scrubbing objects, whether the object is large or small. Various designs are known for brushes specifically intended for cleaning objects such as toilet bowls and laundry sinks. Many brushes are intended for use with an additional cleaning agent. Cleaning agents are available generally in either liquid, powder, or solid form. Liquid cleaning agents work solely by dissolving contaminants on a surface and must of necessity be provided in a concentrated form so that, when added to water, they will retain sufficient strength to be effective. These concentrated liquids present a safety hazard to the typical household, especially significant in households having small children or pets. While cleaning implements with a sponge connected to a reservoir for liquid soap are known, there are no similar implements for use with solid cleaning agents.

Powdered cleaning agents, such as scrubbing powders or "cleansers", typically must be placed onto a brush, rag, sponge, or other implement, then quickly used to cleanse a surface before the powder is washed off of the implement. What is needed instead is a cleaning agent suitable for use with a brush, sponge or rag-like implement that maintains sufficient integrity when immersed in water to allow sufficient time for a thorough cleaning activity.

Solid cleaning agents are typically soft friable natural or synthetic stones that disintegrate in use, releasing abrasive particles which perform a cleansing action when scrubbed across a surface. These stones do not exhibit surfactant, disinfectant, deodorizing or sanitizing properties, and natural stones typically provide a variable abrasive medium because of the natural variability of the stone.

What is needed is a cleaning apparatus that combines a scrubbing capability of a brush with a cleaning agent that can be safely stored, provide a predictable cleaning action, and will last sufficiently long to allow for a thorough scrubbing activity.

Effervescent products, such as effervescent bath salts, are represented by U.S. Pat. No. 6,121,215 to Rau. Rau teaches an effervescent foaming bath product comprised of a base such as a carbonate or bicarbonate, an organic acid, and an anhydrous surfactant, compressed into a form having a specific gravity slightly less than that of water. Rau does not suggest, teach or motivate a practitioner to apply the foaming bath product to a cleanser use.

BRIEF SUMMARY OF THE INVENTION

The invention is generally a scrub brush associated with a handle on one end and a scrubbing portion on the other end, combined with a cleaning agent in the form of a solid which may or may not be capable of effervescing, that is, generating a stream of gas when placed into water. The solid is generally composed of a mixture of chemicals chosen to generate the gas if effervescence is desired, provide a surfactant for lifting and retaining dirt in suspension in the water, and may also have one or more additional features such as a soft grainy texture suitable for scrubbing a surface such as ceramic without scratching it, a disinfectant, deodorant, sanitizer, and/or a fragrance.

The exemplary scrub brush has a handle portion by which the user grips the brush, a scrubber portion which provide the scrubbing action, and a connecting staff or shaft between the two portions. The handle portion may be smooth or molded to provide a comfortable hand grip for the user. The scrubbing portion (herein "brush") may be of bristles, springy plastic mesh, rag-like, or sponge material. The brush is designed so that a portion of the brush furthest from the handle can be compressed into a small diameter cylindrical shape, of such dimension that a suitably sized ring of solid cleaning agent can pass over the compressed brush portion. When the compressed brush portion is released from its restraint, it expands to the original shape and size, thereby confining the ring of solid cleaning agent between the two brush portions.

The solid cleaning agent is formed into a ring shape, with an outer diameter generally similar to the diameter of the brush, and an inner diameter slightly larger than the outer diameter of the compressed portion of the brush. The exemplary embodiment has an outer diameter in a range of approximately three inches to approximately six inches, but could be larger in some embodiments or smaller in other embodiments. In the preferred embodiment, the solid is formed with a generally flat outer surface such as would be achieved by forming a square or rectangular tube into a donut-like circle, thereby providing a contact surface for scrubbing the object to be cleaned. If the present invention is to be used for cleaning food-processing equipment, the solid cleaning agent may be composed of suitable approved food-grade cleaning agents. Other intended uses such as medical equipment may be advantageously cleaned with a solid especially formatted for such use. Commercial cleaning activities may likewise be advantageously cleaned with specific cleaning solids possibly differing from the formulations preferably used for household cleaning. All such varieties of cleaning agent uses are included herein.

BRIEF DESCRIPTION OF THE DRAWING

For fuller understanding of the present invention, reference is made to the accompanying drawing in the following DETAILED DESCRIPTION OF THE INVENTION. Reference numbers refer to the same or equivalent parts of the present invention throughout the several figures of the drawing. In the drawing.

DETAILED DESCRIPTION OF THE INVENTION

Figure 6:
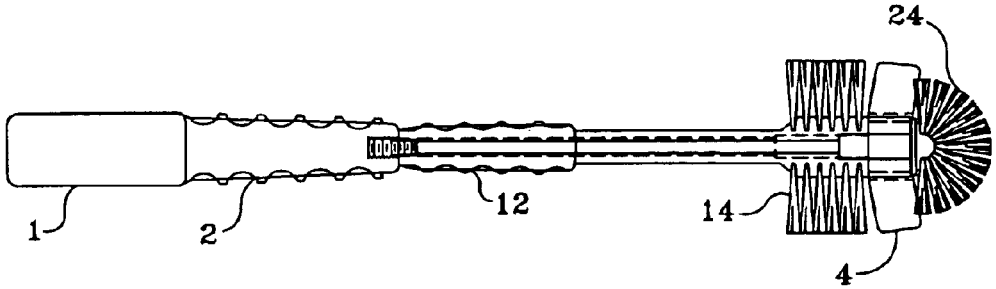
FIG. 6 is a side view of the assembled preferred embodiment with solid cleaning agent in place, ready for use.

Referring to the Figures, FIG. 6 shows an assembled exemplary Brush Assembly with Consumable Cleaning Agent apparatus 100 of the present invention. The following discussion is in terms of a household cleaning apparatus for the sake of explanation and is not intended to be limiting thereby. Additional uses which may require embodiments of the present invention which have a different brush or shaft shape or size such as for cleaning food preparation equipment, medical devices, commercial, public, or medical facilities, etc. are also contemplated by the present invention and are included herein.

Figure 1:
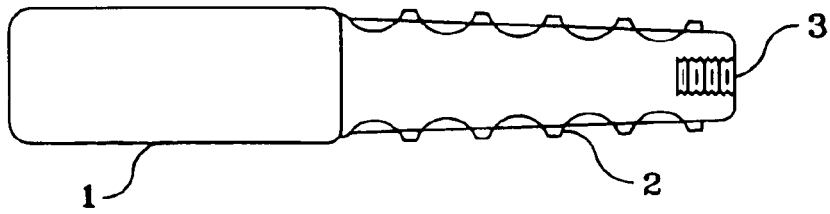
FIG. 1 is a side view of an exemplary handle portion of the preferred embodiment.

FIG. 1 shows the handle component by which the user grasps apparatus 100. The handle may be made of wood, metal or preferably is made of molded plastic material. Smooth portion 1 provides a shape which is easily and economically manufactured. Portion 1 may alternatively be contoured if desired to provide an ergonomically designed gripping surface. Contoured portion 2 is contoured to provide an ergonomical positive gripping surface so that the user may easily operate apparatus 100 as explained below. The handle also contains receptacle 3 which is preferably a threaded recess for receiving a portion of apparatus 100. Alternative locking non-fixed receptacles such as bayonet or twist-lock receptacles may be used, as well as fixed-connection receptacles such as glued, welded, pinned, riveted and the like.

Figure 2:
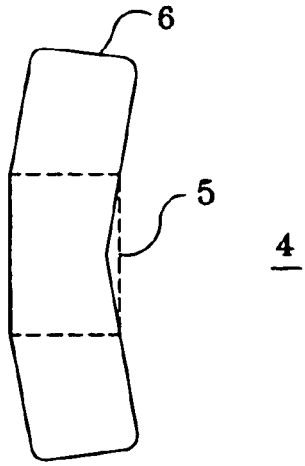
FIG. 2 is side view of an exemplary solid cleaning agent cartridge for use with the preferred embodiment.

FIG. 2 shows the replaceable consumable cleaning agent cartridge 4 of apparatus 100. Cartridge 4, which is described further below, is preferably ring or donut-shaped with a generally rectangular cross section. Circular or elliptical cross sections may also be used. Cartridge 4 has a central bore 5 therethrough which allows cartridge 4 to fit over the brush as explained below. Exterior surface 6 of cartridge 4 is generally flat as indicated and may be inclined slightly to the plane of the ring formed by cartridge 4 to better conform to the object to be scrubbed. The angle of inclination may be in the range of approximately 0° to approximately 45° from the plane of cartridge 4.

Figure 3:
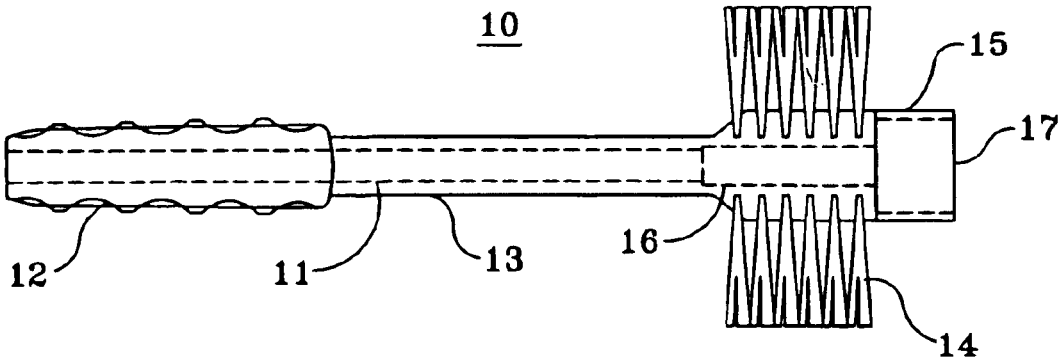
FIG. 3 is a side view of a main brush body of the preferred embodiment.

FIG. 3 shows main brush body 10 of apparatus 100. Contoured handle portion 12 is affixed to or molded onto one end of shaft 13 while first brush 14 is affixed to the other end. Portion 12 provides the user with an ergonomically secure gripping surface for operating the brush. One or more of gripping surfaces 1, 2, and 12 may alternatively be formed with resilient material as is known in the art. Shaft 13 has bore 11 therethrough, making shaft 13 effectively hollow. Shaft 13 may be made of wood, metal, or preferably molded plastic material. First brush 14 may be a bristle material of either stiff or flexible plastic or natural bristles; a natural or synthetic sponge-like material; a rag-like assemblage, or a springy mesh or random aggregation of plastic threads, such as nylon, polypropylene or other similar material, as is known in the art. Collar 15 has a larger bored recess 17 within shaft 13 which is sized to approximately the diameter of compressed second bristles 24 as explained here in below. Recess 16 allows fixed collar 26 to retract on center.

Figure 4:
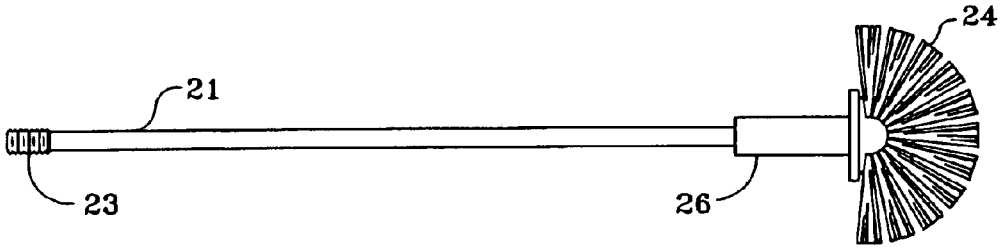
FIG. 4 is a side view of a retractable brush head for use with the body of FIG. 3.

FIG. 4 shows retractable brush head assembly 20 of apparatus 100. Assembly 20 has shaft 21 which is dimensioned to fit moveably within bore 11 of body 10. One end 23 of shaft 21 is threaded as indicated to threadably mate with receptacle 3. Other dismountable connective forms such as bayonet, pin and twist lock, etc. may be used, in which case receptacle 3 and end 23 will be mateably formed. Fixed connective methods such as glued, welded, pinned, riveted, etc. are also contemplated by the present invention, and would require suitably formed mating surfaces for receptacle 3 and end 23. Second brush 24 preferably forms a head or rounded portion of apparatus 100 as indicated in FIG. 4. Other shapes are included herein. Brush 24 may be made of the same materials as brush 14 in any combination, so that brush 14 and brush 24 are the same, or may be different so as to provide two different scrubbing surfaces. Fixed collar 26 is dimensioned to slide into recess 16 and recess 17 compresses brush 24 into configuration 24*a* as shown in FIG. 5.

Figure 5:
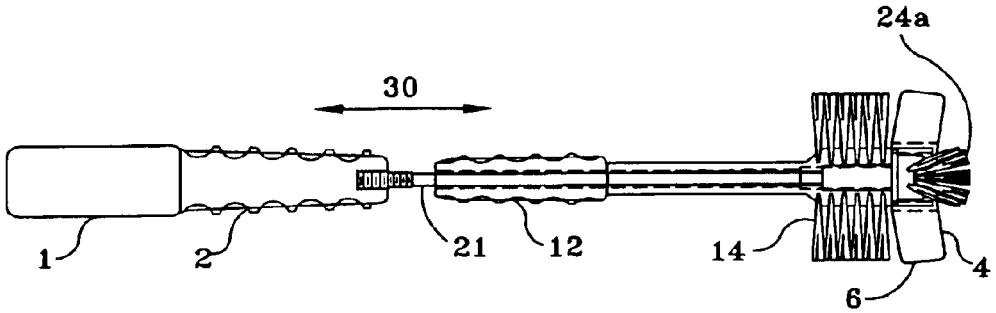
FIG. 5 is a side view of the preferred embodiment indicating the compression of the bristles of the retractable brush head portion of FIG. 4.

FIG. 5 shows the assembled apparatus 100 with assembly 20 passed through bore 11 and end 23 connected with receptacle 3. Arrow 30 indicates the possible relative motion of the components. To use the exemplary apparatus 100, the user moves handle portion 12 toward brush 14. This moves body 10 relative to assembly 20, forcing collar 15 over brush 24 and recess 17 compresses brush 24 into configuration 24*a* as shown in FIG. 5. The user then passes compressed brush 24*a* through bore 5 of cartridge 4, and moves body 10 toward handle portion 1. This allows brush 24*a* to resume the extended configuration of brush 24, holding cartridge 4 between brush 14 and brush 24. The outer diameter of collar 15 centers and retains cartridge 4 in place. In another embodiment, a spring may optionally be inserted so as to bias the apparatus to the closed, ready to use, position. Alternative means to move body 10 such as a cam-lever action, a twisting or screw-like action, or a toggle motion as are known in the art are included herein. FIG. 6 shows the completed apparatus 100 with cartridge 4 in place and brushes 14, 24 ready to use.

An effervescing cartridge 4 is generally a solid capable of generating a stream of gas when placed into water. This effervescence provides for a quick mixture of the released chemicals and assists in suspending removed contaminants in the cleaning water. The solid is generally composed of a mixture of chemicals chosen to generate the gas, provide a disinfection solution with the water, provide a surfactant to aid in the cleaning action, impart a fragrance, and may further have an abrasive additive and soft grainy texture suitable for scrubbing a surface such as a ceramic without scratching it. A non-effervescing solid formed of an alternative mixture of chemicals that provide cleaning action without the effervescent action, as well as combinations of chemicals providing one or more of the desired characteristics above, are included herein.

The mixture may be chosen from some of the following chemicals in the indicated weight-percentage proportions:

sodium chloride crystals 5% to 15%
sodium bicarbonate powder 20% to 40%
alcohol 5% to 20%
disinfectant 0% to 5%
citric acid 25% to 60%
fragrance 0% to 2[{]ps The specific chemicals chosen are determined by the specific use for which the resulting solid is destined. For example, a solid for scrubbing vigorously may need to be more dense, less friable and have a more durable abrasive than one intended for more gentle application. As a minimum, at least citric acid, sodium bicarbonate, a biocide, fragrance, and salt will be included in the final mixture for an effervescing solid to provide the desired effervescence and abrasion. In many instances, more than one member of a chemical family may be suitable. For example, mono, di and tri alcohols may be used to provide desired properties. Further considerations in choosing the ingredients are costs, environmental effects, crystalline stability, deliquesce, hygroscopic and hydrophilic tendencies.

The preferred combination of ingredients for use as a household toilet bowl cleaner, in weight-percentages, is:

citric acid 15% to 40%
sodium bicarbonate 20% to 50%
sodium chloride 5% to 15%
alkali hypochlorite 0.5% to 1.5%
propylene glycol 0.3% to 1%
fragrance 0.5% to 1.5%
sodium carbonate 5% to 10%
para-dichlorobenzene 0.2% to 1[{]ps It is to be understood that this composition can be varied over a wide range as indicated above, choosing specific combinations of chemicals to provide specific desired characteristics such as physical hardness, scrubbing effectiveness, water softening capability, effervescence activity, disinfecting strength, stain removing capacity, deodorizing ability, sanitizing ability, fragrance, and the like. All such compositions are specifically included in the present invention.

Cartridge 4 generally has no dimension greater than six inches, but could be larger in some embodiments or smaller in other embodiments. Further, the solid can be molded into any shape, but preferably is molded into cartridge 4 adapted to be grasped by or secured to an inert handle of a brush as indicated above so that the invention can be used without contacting the skin of the user. When the cartridge is mostly consumed, the brush handle can be retracted, allowing the remainder of cartridge 4 to fall off into the toilet bowl and continue to dissolve, providing additional sanitizing and deodorizing action.

The preferred use of the invention is to attach cartridge 4 to apparatus 100, then dip the brush into water and use it as a scrubber to clean surfaces such as a ceramic toilet bowl. If a planar surface is to be cleaned, repeated dipping of the apparatus 100 into water may be necessary.

The present invention, when used with an effervescing cartridge 4, does not normally contemplate an "interrupted use", that is, a short time use, then removal of apparatus 100 containing cartridge 4 from the water and repackaging apparatus 100 such as placing it in a closed plastic bag, with the intention of using the remainder of cartridge 4 later. In fact, it is an advantage of the present invention that the consumable cleaning agent is used up and the brush may be safely stored as a totally inert object. It is possible, however, that non-effervescing cartridges 4 may be useable in this manner, for example if cartridge 4 is composed of a soap-like combination of ingredients. Both such uses are contemplated by the present invention and are specifically included herein.

Further, a natural or synthetic fragrance and/or an organic or inorganic disinfecting biocide can be added to the mixture forming cartridge 4. The disinfectant may be selected from a group consisting of quaternary ammonium compounds, anionic surfactants, oxygen bleaches, organic bleaches, chlorine compounds, sulfamic acid compounds, and the like. If a disinfectant is included in the composition, the dissolution of the solid releases the disinfectant into the water, making a solution which disinfects and sanitizes its container. Depending on the particular disinfectant used, contact time to be effective can be less than a minute to approximately 20 minutes. Note that the shorter contact time indicates a stronger disinfecting activity and would typically be used by trained applicators in commercial environments. Typical household disinfecting activity would have a contact time of approximately 8 minutes to approximately 12 minutes, preferably approximately 10 minutes.

Cartridge 4 may exhibit rust and scale removal properties as well. The chemical ingredients of cartridge 4 have inherent rust and stain removing properties due to the concentration of citric acid which reacts with the sodium bicarbonate to form sodium salts that serve as rust and scale removers. Sodium EDTA, organic acids such as glycolic acid, gluconic acid, malic acid and the like, can also be added to increase the effectiveness as a rust and scale remover.

INDUSTRIAL APPLICABILITY

The present invention may be readily made of commonly available materials using known manufacturing methods. The apparatus is useful for cleaning items such as toilet fixtures, garbage disposals, food grinders and the like, or medical equipment; wherever vigorous scrubbing and cleaning action is desirable, especially when an accompanying disinfecting and deodorizing action is needed.

Information as herein shown and described in detail is fully capable of attaining the above-described object of the invention, the presently preferred embodiment of the invention, and is, thus, representative of the subject matter which is broadly contemplated by the present invention. Although the description above contains many specificities, these should not be construed as limiting the scope of the invention but as merely providing illustration of some of the presently preferred embodiments of the invention. The scope of the present invention fully encompasses other embodiments which may become obvious to those skilled in the art, and is to be limited, accordingly, by nothing other than the appended claims, wherein reference to an element in the singular is not intended to mean "one and only one" unless explicitly so stated, but rather "one or more". All structural, chemical and functional equivalents to the elements of the above-described preferred embodiment and additional embodiments that are known to those of ordinary skill in the art are hereby expressly incorporated by reference and are intended to be encompassed by the present claims.

Moreover, no requirement exists for a device or method to address each and every problem sought to be resolved by the present invention, for such to be encompassed by the present claims. Furthermore, no element, component, or method step in the present disclosure is intended to be dedicated to the public regardless of whether the element, component, or method step is explicitly recited in the claims. However, it should be readily apparent to those of ordinary skill in the art that various changes and modifications in form, material, and fabrication detail may be made without departing from the spirit and scope of the inventions as set forth in the appended claims. No claim herein is to be construed under the provisions of 35 U.S.C. 112, sixth paragraph, unless the element is expressly recited using the phrase "means for".

What is claimed is:

1. An apparatus comprising:

means for scrubbing having a first portion and a second portion;

a cleaning agent; and means for holding the cleaning agent within the first and second portions of the scrubbing means.

2. An apparatus as in claim 1 wherein the scrubbing means is selected from a group consisting of at least one of bristles, sponge, mesh, and rags.

3. An apparatus as in claim 1 wherein the cleaning agent is selected from a group consisting of effervescent solid, and noneffervescent solid.

4. An apparatus as in claim 3 wherein the solid is ring-like and further comprised of a mixture of chemicals selected from a group consisting of at least one of anionic surfactant, salt, disinfectant, fragrance, abrasive, deodorant, sanitizer, organic acid, base, alcohol, oxygen bleach, chlorine bleach, organic bleach, sulfamic acid compounds, quaternary ammonium compounds, water softener, and sodium EDTA.

5. An apparatus as in claim 1 wherein the holding means confines the cleaning agent between the first portion of the scrubbing means and the second portion of the scrubbing means.

6. An apparatus as in claim 5 wherein the holding means operates by an action selected from a group consisting of sliding action, toggle action, cam-lever action, twisting action, and screw-like action.

7. An apparatus comprising:

scrubbing means selected from a group consisting of at least one of bristles, sponge, rags, and mesh;

a cleaning agent selected from a group consisting of effervescent solid and noneffervescent solid; and means for holding the cleaning agent within the scrubbing means.

8. An apparatus as in claim 7 wherein the solid is ring-like and further comprised of a mixture of chemicals selected from a group consisting of at least one of anionic surfactant, salt, disinfectant, fragrance, abrasive, deodorant, sanitizer, organic acid, base, alcohol, oxygen bleach, chlorine bleach, organic bleach, sulfamic acid compounds, quaternary ammonium compounds, water softener, and sodium EDTA.

9. An apparatus as in claim 8 wherein the holding means confines the cleaning agent between a first portion of the scrubbing means and a second portion of the scrubbing means.

10. An apparatus as in claim 9 wherein the holding means operates by an action selected from a group consisting of sliding action, toggle action, cam-lever action, twisting action, and screw-like action.

11. A method of providing a cleaning apparatus comprising:

providing means for scrubbing having a first portion and a second portion;

providing a solid cleaning agent; and holding the cleaning agent between the first and second portions of the scrubbing means.

12. A method as in claim 11 wherein providing the scrubbing means further comprises choosing a scrubbing means selected from a group consisting of at least one of bristles, sponge, mesh, and rags.

13. A method as in claim 11 wherein providing the cleaning agent further comprises choosing a cleaning agent selected from a group consisting of effervescent solid, and noneffervescent solid.

14. A method as in claim 13 wherein providing the solid cleaning agent further comprises providing a ring-like solid further comprised of a mixture of chemicals selected from a group consisting of at least one of anionic surfactant, salt, disinfectant, fragrance, abrasive, deodorant, sanitizer, organic acid, base, alcohol, oxygen bleach, chlorine bleach, organic bleach, sulfamic acid compounds, quaternary ammonium compounds, water softener, and sodium EDTA.

15. A method as in claim 11 wherein providing a holding means further comprises selecting a holding means that operates by an action selected from a group consisting of sliding action, toggle action, cam-lever action, twisting action, and screw-like action.

16. An apparatus comprising:

a first shaft having an opening longitudinally entirely therethrough and having a first handle at a first end and a first scrubbing means at a distal end, and further having a cavity at the distal end;

a second shaft having a cross sectional dimension suitable for passing through the longitudinal opening in the first shaft and having a second scrubbing means attached at a first end and a distal end adapted for attaching to a second handle, the second scrubbing means compressible into the cavity; and a ring-like solid cleaning agent having an opening therethrough, whereby the cleaning agent is held between the first scrubbing means and the second scrubbing means when the second shaft is passed through the opening in the cleaning agent and the longitudinal opening in the first shaft.

17. An apparatus as in claim 16 at least one of the scrubbing means is selected from a group consisting of at least one of bristles, sponge, mesh, and rags.

18. An apparatus as in claim 16 wherein the cleaning agent is selected from a group consisting of effervescent solid and noneffervescent solid.

19. An apparatus as in claim 18 wherein the solid is further comprised of a mixture of chemicals selected from a group consisting of at least one of anionic surfactant, salt, disinfectant, fragrance, abrasive, deodorant, sanitizer, organic acid, base, alcohol, oxygen bleach, chlorine bleach, organic bleach, sulfamic acid compounds, quaternary ammonium compounds, water softener, and sodium EDTA.

20. An apparatus as in claim 16 wherein the second shaft has a second handle attached to the distal end after the second shaft has been passed through the longitudinal opening in the first shaft.

* * * * *

UNITED STATES PATENT AND TRADEMARK OFFICE

CERTIFICATE OF CORRECTION

PATENT NO. : 6,851,881 B2
DATED : February 8, 2005
INVENTOR(S) : Jeffrey K. Slaboden It is certified that error appears in the above-identified patent and that said Letters Patent is hereby corrected as shown below:

Column 4,
Line 50, please delete "2[{]ps" and replace with -- 2% --.

Column 5,
Line 8, please delete "1[{]ps" and replace with -- 1% --.

Signed and Sealed this

Seventeenth Day of May, 2005

JON W. DUDAS
*Director of the United States Patent and Trademark Office*